US012768603B2

(12) United States Patent
Hoysall et al.

(10) Patent No.: US 12,768,603 B2
(45) Date of Patent: Oct. 20, 2026

(54) FLEXIBLE AND ADJUSTABLE COMPENSATOR FOR MICROCHANNEL INDOOR UNITS

(71) Applicant: Carrier Corporation, Palm Beach Gardens, FL (US)

(72) Inventors: Dhruv Chanakya Hoysall, South Windsor, CT (US); Thomas Bryant, West Seneca, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 192 days.

(21) Appl. No.: 18/738,023

(22) Filed: Jun. 9, 2024

(65) Prior Publication Data

US 2024/0418458 A1 Dec. 19, 2024

Related U.S. Application Data

(60) Provisional application No. 63/508,981, filed on Jun. 19, 2023.

(51) Int. Cl.
*F28F 9/02* (2006.01)
*F28D 7/16* (2006.01)

(52) U.S. Cl.
CPC ..... *F28F 9/026* (2013.01); *F28D 7/16* (2013.01)

(58) Field of Classification Search
CPC ..... F28F 9/026; F28D 7/16; F25B 45/00; F25B 2400/16
USPC ..... 165/175
See application file for complete search history.

(56) References Cited

U.S. PATENT DOCUMENTS

| | | | | |
|---|---|---|---|---|
| 10,330,358 | B2 | 6/2019 | Goel | |
| 10,830,514 | B2 * | 11/2020 | Bachellor | F25B 6/04 |
| 2011/0126559 | A1 * | 6/2011 | Kopko | F25B 49/02 62/79 |
| 2012/0167614 | A1 * | 7/2012 | Jin | F25B 45/00 62/430 |
| 2015/0330685 | A1 * | 11/2015 | Goel | F25B 41/20 137/593 |
| 2019/0323747 | A1 * | 10/2019 | Giles | F25B 39/04 |
| 2021/0207854 | A1 * | 7/2021 | Rahhal | F25B 41/31 |

FOREIGN PATENT DOCUMENTS

CN 114152008 A 3/2022

OTHER PUBLICATIONS

Extended European Search Report received for EP Application No. 24180745.2, mailed on Nov. 15, 2024, 6 Pages.

* cited by examiner

*Primary Examiner* — Steve S Tanenbaum
(74) *Attorney, Agent, or Firm* — Souad Hakim

(57) ABSTRACT

A compensator for an indoor unit of a reversible heat pump is disclosed. The compensator comprises a conduit of a predefined profile having a first end, and a second end. The first end of the conduit is adapted to be fluidically coupled to a thermal expansion device and a primary header of the indoor unit, such that the conduit remains above a connection point between the conduit, the thermal expansion device, and the primary header. The compensator is configured outside the indoor unit in one or more configurations. The compensator stores excess charge created between heating and cooling modes of the heat pump.

20 Claims, 3 Drawing Sheets

FLEXIBLE AND ADJUSTABLE COMPENSATOR FOR MICROCHANNEL INDOOR UNITS

CROSS-REFERENCE TO RELATED APPLICATION

This patent application claims the benefit of U.S. Provisional Patent Application No. 63/508,981, filed on Jun. 19, 2023, which is incorporated by reference herein in its entirety.

BACKGROUND

This invention relates to the field of heat pumps, and more particularly, a compensator for indoor units of reversible heat pumps.

Heat pumps typically have a charge imbalance between heating and cooling modes. Existing charge management strategies may not be sufficient to store excess charge. There is, therefore, a need to provide a simple, adjustable, and cost-effective compensator that can be easily integrated with indoor units to enable charge balancing.

SUMMARY

Described herein is a compensator for an indoor unit of a reversible heat pump. The compensator comprises a conduit of a predefined profile having a first end and a second end; wherein the first end of the conduit is adapted to be fluidically coupled to a thermal expansion device and a primary header of the indoor unit, such that the conduit remains above a connection point between the conduit, the thermal expansion device, and the primary header.

In one or more embodiments, the conduit is positioned outside the indoor unit.

In one or more embodiments, the conduit is positioned below the primary header and above the connection point.

In one or more embodiments, at least a length of the conduit is above the primary header.

In one or more embodiments, the conduit is removably coupled to the indoor unit.

In one or more embodiments, the first end of the conduit is connected to a predetermined connection point on a supply tube that fluidically connects the thermal expansion device and the primary header, such that the conduit remains above the predetermined connection point.

In one or more embodiments, the compensator comprises a three-port connector, wherein the first end of the conduit is connected to a first port of the connector, an outlet of the thermal expansion device is connected to a second port of the connector, and a third port of the connector is connected to an inlet of the primary header.

In one or more embodiments, the conduit is adapted to be machined/fabricated in the predefined profile based on an outer profile of a housing of the indoor unit, wherein the conduit is wrapped around the housing of the indoor unit.

In one or more embodiments, the predefined profile of the conduit is a serpentine configuration comprising a predefined number of turns.

In one or more embodiments, the predefined profile of the conduit is a vertical configuration.

In one or more embodiments, the indoor unit is a heat exchanger comprising indoor coils including a plurality of microchannel tubes, wherein the indoor unit is fluidically connected to an outdoor unit comprising outdoor coils that includes a plurality of round tube plate fin tubes.

In one or more embodiments, a length and an inner diameter of the conduit is selected based on a volumetric difference between the outdoor coils and the indoor coils of the reversible heat pump.

In one or more embodiments, the conduit is made of one or more of copper, ferrous metal, non-ferrous metal, non-metals, and alloys.

In one or more embodiments, the conduit is made of a flexible material that is adapted to be adjusted to the predefined profile.

Also described herein is an indoor unit for a reversible heat pump. The indoor unit comprises a primary header, a secondary header, indoor coils comprising a plurality of microchannel tubes extending between and fluidically coupling the primary header and the secondary header, and a compensator comprising a conduit of a predefined profile having a first end and a second end, wherein the first end of the compensator is adapted to be fluidically coupled to a thermal expansion device and the primary header, such that the compensator remains above a connection point between the conduit, the thermal expansion device, and the primary header, and wherein the compensator is positioned outside the indoor unit.

In one or more embodiments, the indoor unit is fluidically connected to an outdoor unit comprising outdoor coils including a plurality of round tube plate fin tubes, and wherein a length and an inner diameter of the conduit is selected based on a volumetric difference between the outdoor coils and the indoor coils of the reversible heat pump.

In one or more embodiments, the compensator comprises a three-port connector, wherein the first end of the conduit is connected to a first port of the connector, an outlet of the thermal expansion device is connected to a second port of the connector, and a third port of the connector is connected to an inlet of the primary header.

In one or more embodiments, the conduit has the predefined profile based on an outer profile of a housing of the indoor unit, wherein the conduit is wrapped around the housing of the indoor unit.

In one or more embodiments, the predefined profile of the conduit is a serpentine configuration comprising a predefined number of turns.

In one or more embodiments, the predefined profile of the conduit is a vertical configuration.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
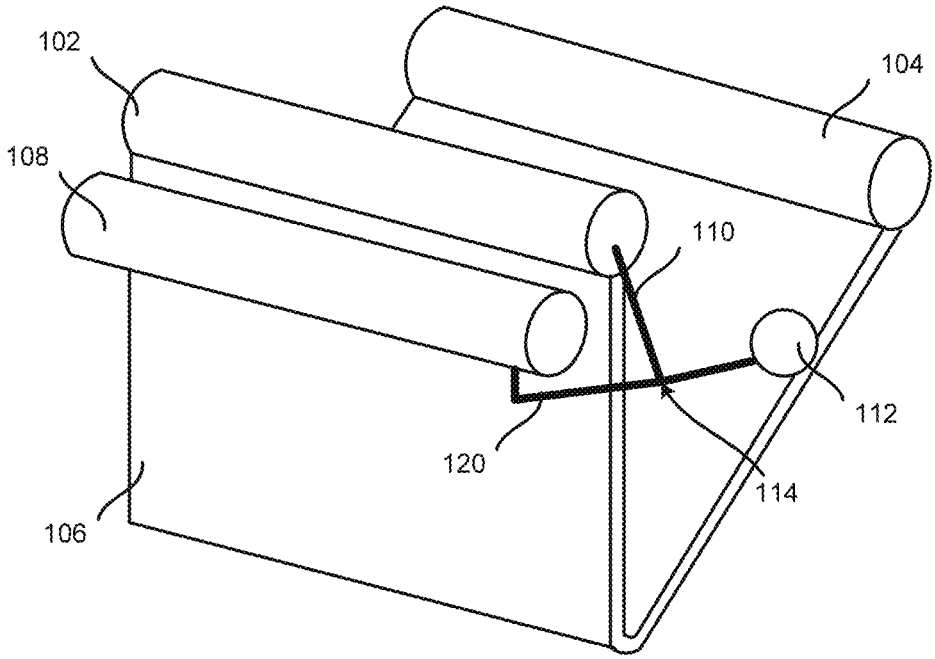
FIGS. 1A and 1B illustrate exemplary views of a first design of the compensator implemented in an indoor unit in accordance with one or more embodiments of the disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the auxiliary header, multichannel tube, first and second header, indoor unit, heat exchanger, and corresponding components, described herein may be oriented in any desired direction.

An indoor unit such as a microchannel heat exchanger (MCHX) includes multiple microchannel tubes having multiple inlet ports, which connect and extend from an inlet manifold (first header) to an outlet manifold (second header) of the heat exchanger. As the MCHX is used as an indoor unit across various air conditioners and heat pumps, they generally have a charge imbalance between heating and cooling modes. Heat pumps typically have a charge imbalance between heat and cooling modes, which may be created due to excess charge generated between heating and cooling modes.

Existing charge management strategies are not large enough to store the excess charge of the heat pumps. This charge imbalance can damage the indoor unit as well as the overall cooling and heating system, leading to a drop in performance, and system shutdowns in severe conditions. Moreover, this charge imbalance is exacerbated with the use of the microchannel ID coils in MCHX indoor unit as they have much smaller internal volumes. Thus, charge management strategies are the biggest bottlenecks in the adoption of MCHX in heat pumps. This invention provides a simple, adjustable, and cost-effective compensator that can be easily integrated with indoor units to enable charge balancing.

Referring to FIG. 1A to 2B, the charge compensator 108 for a microchannel indoor unit is disclosed. The indoor unit includes an inlet manifold 102 (also referred to as first header 102 or primary header 102, hereinafter), an outlet manifold 104 (also referred to as second header 104 or secondary header 104, hereinafter), and a plurality of microchannel tubes 106 extending between and fluidically coupling the primary header 102 and the secondary header 104. The indoor unit may be associated with a refrigeration system and/or with a heat pump. The indoor unit generally includes a supply tube 110 connecting a refrigeration line and a thermal expansion device 112 of the indoor unit to the primary header 102. The charge compensator 108 is designed as a conduit (also designated as 108, herein) of a predefined profile (in addition to the primary and secondary header 102, 104). The first end of the compensator 108 is adapted to be fluidically coupled to the thermal expansion device 112 and the primary header 102 of the indoor unit, such that the conduit (compensator) remains above a connection point 114 between the conduit 108, the thermal expansion device 112, and the primary header 102. In some embodiments, the compensator 108 may be removably coupled to the thermal expansion device 112 and the primary header 102 of the indoor unit from outside of the indoor unit 102, which allows easier retrofitting of the compensator 108 with the existing indoor units. This also reduces the chances of corrosion in the compensator 108, thereby allowing the use of copper or other piping materials in the compensator 108. However, the compensator 108 may also be an integral part of the indoor unit. The conduit 108 acts as the charge compensator that stores excess charge generated between the heating and cooling modes of the heat pump.

The compensator 108 may be positioned anywhere outside the indoor unit as far as at least a length of the compensator 108 remains above the connection point 114 between the compensator 108, the primary header 102, and the expansion device 112. In one or more embodiments, the first end of the conduit can be connected to a predetermined connection point 114 on the supply tube 110, such that the conduit 108 remains above the predetermined connection point 114. In addition, the compensator 108 can include a three-port connector 116 at the predefined connection point 114. The first end of the conduit 108 can be connected to a first port of the connector 116, an outlet of the thermal expansion device 112 can be connected to a second port of the connector 116, and a third port of the connector 116 can be connected to an inlet of the primary header 102, however, the conduit 108 has to be positioned above the three-port connector 116.

Figure 1B:
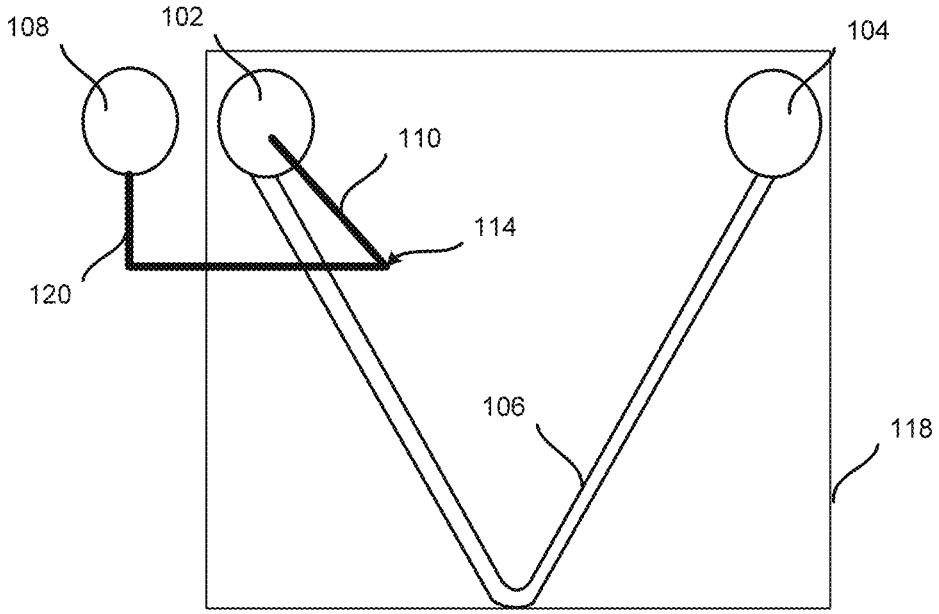
Figure 1C:
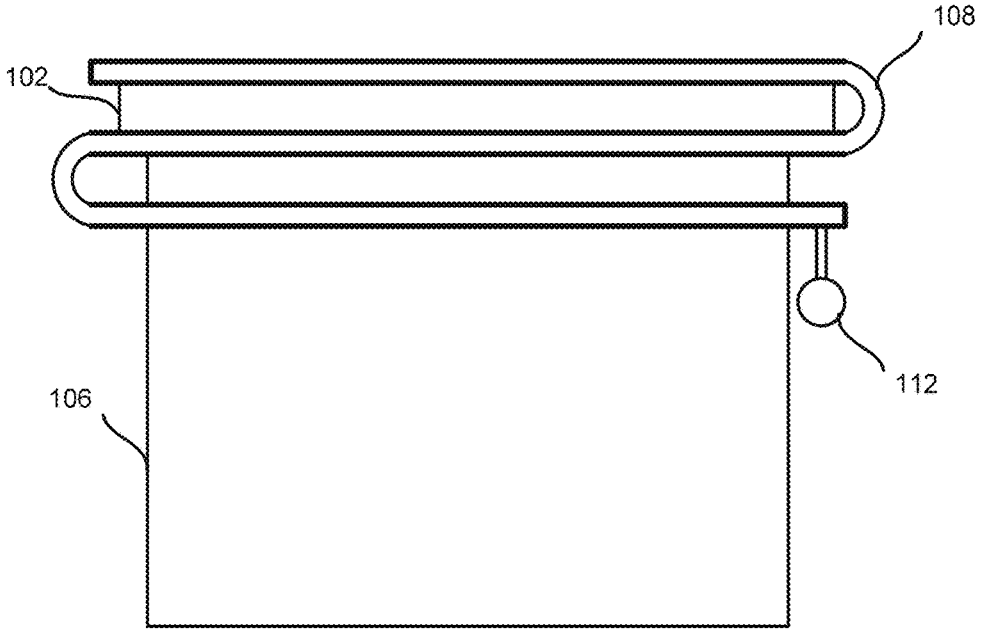
FIGS. 1C and 1D illustrate exemplary views of a second design of the compensator implemented in an indoor unit in accordance with one or more embodiments of the disclosure.
Figure 1D:
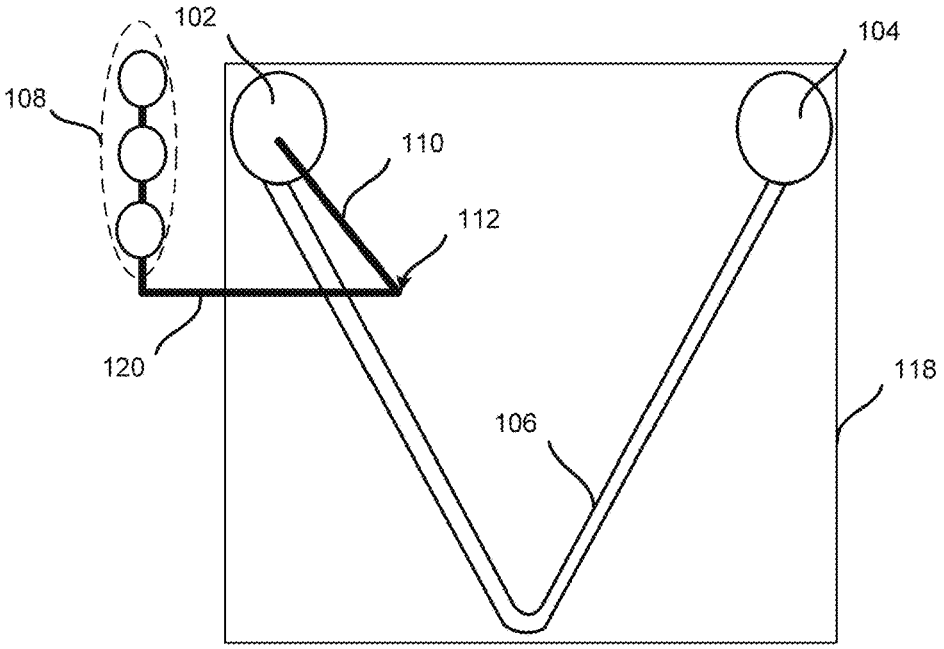

In one or more embodiments, as shown in FIGS. 1C and 1D, the conduit 108 can be adapted to be machined/fabricated in a serpentine configuration comprising a predefined number of turns, so that a portion of the conduit 108 remains above the connection point 114. In one or more embodiments, the conduit 108 can be adapted to be machined/fabricated in the predefined profile based on an outer profile of a housing 118 of the indoor unit, so that the conduit 108 can be wrapped around the housing 118 of the indoor unit. In one or more embodiments, the conduit 108 can be in a vertical configuration with the first end of the conduit 108 connected to the connection point 114 and the second end of the conduit 108 extending vertically upward, so that the conduit 108 remains above the connection point 114.

In one or more embodiments, as shown in FIGS. 1A and 1B, the conduit 108 can be a cylindrical housing being configured at a predefined height above (from the horizontal plane of) the primary header 102 such that the conduit 108 remains above the connection point 114. An additional tube 120 can be used to fluidically connect the cylindrical compensator 108 to the connection point 114. In some embodiments, the compensator 108 and the primary header 102 may be at the same elevation such that the compensator 108 and the primary header 102 remains in the same horizontal plane, however, the compensator 108 must remain above the connection point 114 between the compensator 108 and the primary header 102. Further, in other embodiments, the compensator 108 may be configured parallel to the primary header 102 and at a predefined height below the horizontal plane of the primary header 102 without any limitation, however, the compensator 108 must remain above the connection point 114 between the compensator 108 and the primary header 102. Furthermore, the compensator 108 may be configured nonparallel to the primary header 102 such that the longitudinal axis of the auxiliary header 108 and the primary header 102 remains nonparallel to each other, however, the compensator 108 must remain above the connection point 114 between the compensator and the primary header 102.

It should be obvious to a person skilled in the art that while FIG. 1A to 1D and some embodiments of this invention have been elaborated for the compensator 108 having the predefined profile comprising wrapped configuration, serpentine configuration, vertical configuration, and horizontal configuration for the sake of simplicity and better explanation purpose, however, the teachings of this invention are equally applicable for compensator having other profiles as long as a length of the compensator remains above the connection point, and all such embodiments are well within the scope of this invention.

In one or more embodiments, the indoor unit can be a heat exchanger comprising indoor (ID) coils including the plurality of microchannel tubes 106. The indoor unit can be fluidically connected to an outdoor unit comprising outdoor (OD) coils that include a plurality of round tube plate fin tubes. The length and inner diameter of the compensator/conduit 108 can be selected based on a volumetric difference between the outdoor coils and the indoor coils of the reversible heat pump. Further, the conduit/compensator 108 may be disposed of outside the housing 118 of the indoor unit, but in proximity to the indoor unit, which may facilitate efficient packaging of the compensator 108 and keeping the overall indoor unit compact.

In one or more embodiments, the compensator 108 and the primary header 102 may be hollow member having a cylindrical profile. The compensator 108 can be made of a flexible material that is adapted to be adjusted to the predefined profile. The compensator 108 can be one or more of copper, ferrous metal, non-ferrous metal, non-metals, and alloys.

In one or more embodiments, the supply tube 110 may be directly disposed of within the primary header 102 through a flat base at one of the ends of the primary header such 102 that a section of the supply tube 110 after the connection point 114 remains parallel to a longitudinal axis of the primary header 102. Further, an additional distributor in form of a nozzle may be fitted at an outlet of the supply tube 110 within the primary header 102 such that the refrigerant ejected by the distributor/nozzle within the primary header 102 nearly covers the entire diameter and length of the primary header 102. However, in other embodiments (not shown), the supply tube 110 may have an L-shaped profile with a first section extending upward from the connection point 114 and a second section extending perpendicular to the first section such that the second section of the supply tube 110 remains parallel to a longitudinal axis of the primary header 102.

In an embodiment, a slot based may be punched at one end of the compensator 108 and a tube 120 extending from the connection point 114 may be inserted within the compensator 108 followed by brazing the tube 120 with the compensator 108. The ends of the compensator 108 are closed by caps using brazing or welding technique to provide a leak-proof compensator. In another embodiment, the connecting tube 120 may also be attached or disposed of within the compensator 108 using 3-D printing techniques, and other known techniques known in the art.

Figure 2:
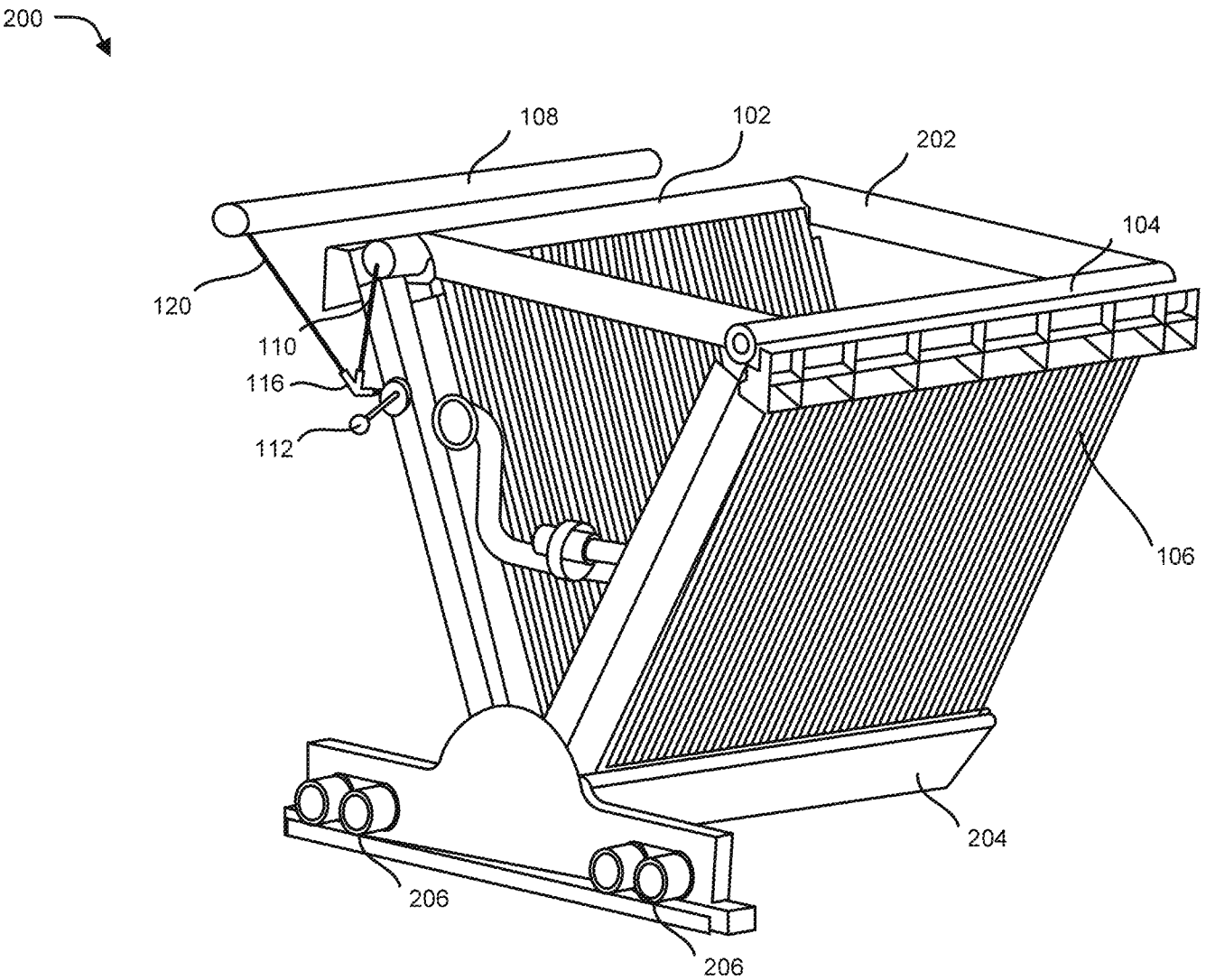
FIG. 2 illustrates an exemplary view of an indoor unit having the compensator configured with the primary header and an expansion device in accordance with one or more embodiments of the disclosure.

Referring to FIG. 2, an exemplary embodiment of the indoor unit 200 of this invention is illustrated. The indoor unit 200 includes an inlet manifold 102 (primary header or primary header) and an outlet manifold 104 (secondary header or secondary header), which may preferably be configured horizontally over a support structure 202 at the same elevation, however, in other embodiments, the primary header 102 may also be positioned at an elevated height above the secondary header 104. Further, the indoor unit 200 includes a plurality of multichannel tubes "tubes" 106 in fluidic communication with the primary header 102 and the secondary header 104. The tubes 106 are equally spaced and extend parallelly, with one end (first end) of the tube disposed of within the primary header 102 and the other end extending out of the primary header 102 at a predefined angle and further connected to and disposed of in the secondary header 104 forming a V-coil design as shown in FIG. 2, however, the tubes 106 can also extend vertically downward from the primary header 102 to enable the flow of the fluid in the vertically downward direction in case of a downward fluid flow heat exchanger. Further, in other embodiments (not shown), the tubes 106 can also extend vertically upward from the primary header 102 to enable the flow of the fluid in the vertically upward direction in case of upward fluid flow heat exchangers.

The indoor unit 200 further includes the charge compensator 108 of FIGS. 1A to 1D that can be designed as a conduit 108 of a predefined profile (in addition to the first and secondary header 104 of the indoor unit 200). The first end of the conduit 108 is adapted to be fluidically coupled to a thermal expansion device 112 and a primary header 102 of the indoor unit, such that the conduit 108 remains above a connection point 114 between the conduit 108, the thermal expansion device 112, and the primary header 102. The conduit 108 act as a charge compensator that stores excess charge generated between the heating and cooling modes of the heat pump, thereby improving the performance, efficiency, and longevity of the overall indoor unit 200 and the heat pump.

The microchannel tubes 106 includes a hollow member which may preferably have a flat profile having opposite flat walls, however, the tubes 106 may also have other profiles without any limitations and all such embodiments are well within the scope of this invention. Further, tube 106 includes multiple channels configured along an axis of the tube 106 therewithin and extending parallelly between a first end and a second end of the hollow member such that multiple fluid flow paths of a predefined radius (for example, generally in the range of millimeters) are created between the first end and second end of the tube 106, which allows fluid such as refrigerant to flow from inlet ports of channels at the first end to the outlet ports of the channels at the second end of the tube 106.

Tubes 106 are preferentially made of a lightweight, thermally conductive, and chemical-resistant material; however, the tubes 106 may also be made of other materials as well, which are within the scope of this invention. In one embodiment, tube 106 may be made of aluminum extrusions. The tubes 106 are shown in drawings hereof, for ease and clarity of illustration, as having a fixed number of channels defining flow paths having a square cross-section. However, it is to be understood that in commercial applications, such as for example refrigerant vapor compression systems, each multichannel tube 106 typically has about ten to twenty flow channels, but may have a greater or a lesser multiplicity of channels, as desired.

The first end of the tube 106 is adapted to be disposed of within the primary header 102 of the indoor unit 200 using the brazing technique, 3-D printing technique, and other known techniques known in the art, such that a certain portion (near the first end) of the tube 106 is disposed of within the primary header 102 and rest portion of the tube 106 protrudes out of the primary header 102 in the downward (or upward) direction from the outer surface of the primary header 102. Further, the second end of the tube 106 is adapted to be disposed of within the secondary header 104 of the heat exchanger 200 using the brazing technique, 3-D printing technique, and other known techniques known in the art, such that a certain portion (near the second end) of the tube 106 is disposed of within the secondary header 104.

The headers 102, 104 are preferably made up of cylindrical, aluminum tubing/housing having aluminum braze cladding on its exterior surface, however, the headers 102, 104 may also have a square, rectangular, hexagonal, octagonal, or other polygonal cross-section. On their facing sides, the headers 102, 104 are provided with a series of generally parallel openings for the receipt of the corresponding ends of the tubes 106, such that the ends or sections of the tubes 106 remain within the headers 102, 104. The tubes 106 are preferably formed of aluminum extrusions. The headers 102, 104 are preferably welded or brazed with the tubes 106. Further, each of the headers 102, 104 is provided with substantially spherical domes to improve the pressure resistance of the headers 102, 104. The headers 102, 104 have opposite ends closed by caps brazed or welded thereto. In the preferred embodiment, the various components are all brazed together, and accordingly, in the usual case, brazing is employed to fasten the caps on opposite ends of the headers 102, 104.

In an embodiment, a slot based on the diameter of the supply tube 110 is punched at one end of the primary header 102 and the supply tube 110 is inserted within the primary header 102 followed by brazing the supply tube 110 with the primary header 102. An additional distributor or nozzle is fitted at the outlet of the supply tube 110 within the primary header 102 and the ends of the primary header 102 are closed by caps using brazing or welding technique to provide a leak-proof design. In another embodiment, the supply tube 110 may also be attached or disposed of within the primary header 102 using 3-D printing techniques, and other known techniques known in the art.

Further, the indoor unit 200 includes louvered heat-dissipating fins of brazed-clad aluminum extending parallelly between adjacent microchannel tubes 106. The fins facilitate the exchange of heat between the fluid flowing through the tubes 106 and air flowing across the tubes 106 of the indoor unit 200. Besides, the fins also provide structural support and rigidity to the tubes 106 as well as the heat exchanger 200.

In one embodiment, as shown in FIG. 2, the indoor unit 200 can be a V-coil arrangement heat exchanger 200 having the primary header 102 and the secondary header 104 oriented horizontally in the same plane over the support structure. Further, tubes 106 protrudes from the primary header 102 making an acute angle from the plane of the primary header 102 in a downward direction and further extending in an upward direction at the same acute angle into the secondary header 104, such that the V-coil arrangement of the tubes 106 having a bend at bottom mid-point of the tubes is formed. The bend at the bottom of tubes 106 results in the formation of an apex at the approximate midpoint of the V-shaped tubes 106. The apex is below the plane defined by the headers 102, 104. Further, a condensate trough 204 is attached along the apex or bend of the tubes by fasteners, extending along an axis parallel to the longitudinal axis of the headers 102, 104. Trough 204 is configured to collect condensate formed in the tubes 106 and the V-coil arrangement facilitates an easier flow of condensate towards the bottom trough 204. The trough 204 may be further provided with one or more condensate outlet 206 fittings to remove the collected condensate.

In one or more embodiments, the indoor unit 200 may be associated with a reversible heat pump, which can be further fluidically connected to an outdoor unit of the heat pump via pipes, a compressor, a reversing valve, and an expansion device 112. During cooling mode/cycle, the indoor (ID) coils (microchannel tubes) of the indoor unit 200 act as an evaporator, and the outdoor (OD) coils associated with the outdoor unit act as a condenser. Further, during heating mode/cycle, the ID coils of the indoor unit 200 act as the condenser, and the OD coils associated with the outdoor unit acts as the evaporator. The heat pump may use round-tube plate fin (RTPF) coils as the OD coils in the outdoor unit and the microchannel tubes of the indoor unit may be the ID coils.

During the cooling cycle, liquid refrigerant passes through the expansion device 112, changing to a low-pressure liquid/vapor mixture that then goes to the ID coil (which acts as the evaporator) or microchannel tubes 106 via the supply tube 110, and the primary header 102, leading homogeneous two-phase flow. A distributor enhances the port-to-port distribution in the microchannel tubes 106 within the primary header 102 without an increase in the pressure drop. The liquid refrigerant then flows into the microchannel tubes 106 and absorbs heat from the indoor air flowing across the microchannel tubes 106 of the indoor unit and boils, thereby becoming a low-temperature vapor. This vapor is then compressed by the compressor, reducing its volume and causing it to heat up. Finally, the gas, which is now hot, passes through the reversing valve to the OD coil (which acts as the condenser). The heat from the hot gas is transferred to the outdoor air, causing the refrigerant to condense into a liquid. This liquid returns to the expansion device 112, and the cycle may be repeated.

During the heating cycle, the liquid refrigerant passes through the expansion device 112, changing to a low-pressure liquid/vapor mixture that then goes to the OD coil (which acts as the evaporator). The liquid refrigerant absorbs heat from the outdoor air and boils, becoming a low-temperature vapor. This vapor is then compressed, reducing its volume and causing it to heat up. Finally, the reversing valve sends the gas, which is now hot, to the ID coil (which is the condenser). The heated gas enters the secondary header 104 and flows into the primary header 102 via the microchannel tubes/ID coil 106. The heat from the hot gas is transferred to the indoor air flowing across the ID coils 106, causing the refrigerant to condense into a liquid. The liquid may then return to the expansion device 112 and the cycle is repeated. However, any excess liquid refrigerant generated in the ID coils 106 can be supplied to and stored in the compensator 108 via connection point 114 and tube 120, thereby storing the excess charge. As the compensator 108 remains above connection point 114, the liquid refrigerant filled in the compensator 108 may later be supplied back to the expansion device 112 under the effect of gravity without the use of any control strategy.

Thus, the compensator 108 acts as a passive charge balancing system in the heat pump, which can store the excess charge generated in the heat pump due to any charge imbalance between the heating cycle and cooling cycle, and without any control strategy, thereby improving the performance, efficiency, and longevity of the overall indoor unit and the heat pump. In addition, as the compensator 108 facilitates charge balancing in the heat pump, the compensator 108 enables the use of round-tube plate fin (RTPF) coils as the OD coils in the outdoor unit along with the microchannel tubes as the ID coils in the heat pump.

It should be obvious to a person skilled in the art that while the figures and some embodiments of this invention have been elaborated for the V-coil arrangement heat exchanger for the sake of simplicity and better explanation purpose, however, the teachings of this invention are equally applicable for other heat exchanger having upward or downward fluid flow configuration such as A-coil heat exchanger, slab-design heat exchanger, N-coil heat exchanger, J-coil heat exchanger, U-coil heat exchanger, and the like, and all such embodiments are well within the scope of this invention.

Thus, this invention overcomes the drawbacks, limitations, and shortcomings associated with existing technologies by providing a simple, adjustable, and cost-effective compensator that can be easily integrated or retrofitted with indoor units, which enables facilitates charge balancing and compensation.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A compensator for an indoor unit of a reversible heat pump, the compensator comprising:

a conduit of a predefined profile having a first end, and a second end;

wherein the first end of the conduit is adapted to be fluidically coupled to a thermal expansion device and a primary header of the indoor unit, such that the conduit remains positioned vertically above a connection point between the conduit, the thermal expansion device, and the primary header, wherein the conduit is wrapped around the housing of the indoor unit.

2. The compensator of claim 1, wherein the conduit is positioned outside the indoor unit.

3. The compensator of claim 1, wherein the conduit is positioned vertically below the primary header and above the connection point.

4. The compensator of claim 1, wherein at least a length of the conduit is positioned vertically above the primary header.

5. The compensator of claim 1, wherein the conduit is removably coupled to the indoor unit.

6. The compensator of claim 1, wherein the first end of the conduit is connected to a predetermined connection point on a supply tube that fluidically connects the thermal expansion device and the primary header, such that the conduit remains positioned vertically above the predetermined connection point.

7. The compensator of claim 1, wherein the compensator comprises a three-port connector, wherein the first end of the conduit is connected to a first port of the connector, an outlet of the thermal expansion device is connected to a second port of the connector, and a third port of the connector is connected to an inlet of the primary header.

8. The compensator of claim 1, wherein the conduit is adapted to be machined/fabricated in the predefined profile based on an outer profile of a housing of the indoor unit.

9. The compensator of claim 1, wherein the predefined profile of the conduit is a serpentine configuration comprising a predefined number of turns.

10. The compensator of claim 1, wherein the predefined profile of the conduit is a vertical configuration.

11. The compensator of claim 1, wherein the indoor unit is a heat exchanger comprising indoor coils including a plurality of microchannel tubes, wherein the indoor unit is fluidically connected to an outdoor unit comprising outdoor coils that includes a plurality of round tube plate fin tubes.

12. The compensator of claim 1, wherein a length and an inner diameter of the conduit is selected based on a volumetric difference between the outdoor coils and the indoor coils of the reversible heat pump.

13. The compensator of claim 1, wherein the conduit is made of one or more of copper, ferrous metal, non-ferrous metal, non-metals, and alloys.

14. The compensator of claim 1, wherein the conduit is made of a flexible material that is adapted to be adjusted to the predefined profile.

15. An indoor unit for a reversible heat pump, the indoor unit comprising:

a primary header;

a secondary header;

indoor coils comprising a plurality of microchannel tubes extending between and fluidically coupling the primary header and the secondary header; and a compensator comprising a conduit of a predefined profile having a first end and a second end;

wherein the first end of the compensator is adapted to be fluidically coupled to a thermal expansion device and the primary header, such that the compensator remains positioned vertically above a connection point between the conduit, the thermal expansion device, and the primary header, and wherein the compensator is positioned outside the indoor unit, and wherein the conduit is wrapped around the housing of the indoor unit.

16. The indoor unit of claim 15, wherein the indoor unit is fluidically connected to an outdoor unit comprising outdoor coils including a plurality of round tube plate fin tubes, and wherein a length and an inner diameter of the conduit is selected based on a volumetric difference between the outdoor coils and the indoor coils of the reversible heat pump.

17. The compensator of claim 15, wherein the compensator comprises a three-port connector, wherein the first end of the conduit is connected to a first port of the connector, an outlet of the thermal expansion device is connected to a second port of the connector, and a third port of the connector is connected to an inlet of the primary header.

18. The compensator of claim 15, wherein the conduit has the predefined profile based on an outer profile of a housing of the indoor unit.

19. The compensator of claim 15, wherein the predefined profile of the conduit is a serpentine configuration comprising a predefined number of turns.

20. The compensator of claim 15, wherein the predefined profile of the conduit is a vertical configuration.

* * * * *